US006877956B2

(12) United States Patent
Gazzillo et al.

(10) Patent No.: US 6,877,956 B2
(45) Date of Patent: Apr. 12, 2005

(54) METHODS AND APPARATUS FOR INTEGRAL RADIAL LEAKAGE SEAL

(75) Inventors: Clement Gazzillo, Schenectady, NY (US); Ronald Wayne Korzun, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 210 days.

(21) Appl. No.: 10/328,053

(22) Filed: Dec. 23, 2002

(65) Prior Publication Data

US 2004/0120819 A1 Jun. 24, 2004

(51) Int. Cl.[7] ..... F01D 5/22
(52) U.S. Cl. ..... 416/191; 416/195; 29/889.21
(58) Field of Search ..... 416/191, 190, 416/192, 195, 185; 29/889.21, 889.2

(56) References Cited

U.S. PATENT DOCUMENTS

| | | | | |
|---|---|---|---|---|
| 1,423,466 A | * | 7/1922 | Edwin | 416/191 |
| 2,220,918 A | * | 11/1940 | Smith | 416/191 |
| 2,283,901 A | * | 5/1942 | Arnold | 416/191 |
| 2,347,034 A | * | 4/1944 | Doran | 416/191 |
| 4,177,011 A | * | 12/1979 | Eskesen et al. | 416/191 |
| 4,840,539 A | * | 6/1989 | Bourcier et al. | 416/191 |
| 5,509,784 A | | 4/1996 | Caruso et al. | |
| 5,890,873 A | | 4/1999 | Willey | |
| 6,036,437 A | | 3/2000 | Wolfe et al. | |
| 6,158,104 A | | 12/2000 | Roberts et al. | |
| 6,322,323 B1 | | 11/2001 | Komiyama et al. | |
| 6,363,612 B1 | | 4/2002 | Roberts et al. | |
| 6,431,827 B1 | | 8/2002 | Wolfe et al. | |
| 6,435,513 B2 | | 8/2002 | Skinner et al. | |
| 6,439,844 B1 | | 8/2002 | Turnquist et al. | |

FOREIGN PATENT DOCUMENTS

JP 55023320 A * 2/1980 ..... F01D/5/22

* cited by examiner

*Primary Examiner*—Thomas Denion
*Assistant Examiner*—Theresa Trieu
(74) *Attorney, Agent, or Firm*—Armstrong Teasdale LLP

(57) ABSTRACT

A method and apparatus for fabricating a rotor assembly for a turbine is provided. The method includes forming a cover on each bucket radial tip wherein the cover includes a leading edge side in a direction of rotation, and a trailing edge side in the direction of rotation wherein the leading edge and trailing edges are parallel with respect to each other, and wherein the leading edge and trailing edges are skewed with respect to the axis of rotation. The method includes forming an extension in the cover leading edge side, forming a groove in the cover trailing edge side, and attaching each bucket to the radially outer rim, such that the extension in the cover leading edge side of one cover is in mating engagement with the groove in the cover trailing edge side of an adjoining cover.

20 Claims, 5 Drawing Sheets

METHODS AND APPARATUS FOR INTEGRAL RADIAL LEAKAGE SEAL

BACKGROUND OF THE INVENTION

This invention relates generally to turbine rotor assemblies and, more particularly, to seal systems for sealing radial leakage in turbine bucket covers.

Known steam turbines are classified as action turbines, or "constant-pressure" turbines and reaction turbines, or "excess-pressure" turbines. Each turbine includes a turbine shaft that includes moving blades, or buckets positioned circumferentially around the shaft, and includes an inner casing with guide blades, or diaphragms positioned between axially spaced buckets.

In the case of a constant-pressure turbine, the entire energy gradient is converted essentially into kinetic flow energy in the ducts that are narrowed by the guide blades. During the process, the velocity rises and the pressure falls. In the moving blades, the pressure and relative velocity remain essentially constant, being achieved through ducts having a uniform clear width. Because the direction of the relative velocity changes, action forces occur that drive the moving blades and, thus, cause rotation of the turbine shaft. The magnitude of the absolute velocity decreases considerably when the flow passes around the moving blades, resulting in a flow that transfers a large part of its kinetic energy to the moving blades and, therefore, to the turbine shaft.

In the case of an excess-pressure turbine, only part of the energy gradient is converted into kinetic energy when the flow passes through the guide blades. The rest of the energy gradient brings about an increase in relative velocity within the moving-blade ducts formed between the moving blades. Where the blade forces are almost exclusively action forces in the constant-pressure turbine, in an excess-pressure turbine, a greater or lesser fraction resulting from the change in the velocity magnitude is added. The term "excess-pressure" turbine is derived from the pressure difference between the downstream and the upstream side of the moving blade. In an excess-pressure turbine, therefore, a change in the velocity magnitude takes place when the pressure varies.

A turbine typically includes at least one rotor including a plurality of rotor buckets or blades that extend radially outwardly from a plurality of wheels attached to a common annular shaft. Specifically, the rotor buckets are attached to the wheels with dovetail joints. A radial extrema of the bucket, or tip may support a cover that joins the tips of a plurality of buckets circumferentially around the periphery of the turbine. In some known bucket designs the cover is individual to each bucket and integrally cast with the bucket during manufacture.

A gap between adjacent bucket covers may define a radial leakage path that may allow the working fluid to escape the bucket surfaces and adversely affect an operational efficiency of the turbine.

To facilitate reducing radial leakage, rotor assemblies may include sealing covers. At least some known rotor assemblies include additional loose fitting seals that are separate from the bucket covers. The seals block the leakage path to reduce radial leakage.

During operation, forces induced within the bucket may cause the adjacent bucket covers to flex and to separate from each other increasing the width of the leakage gap. Over time, continued leakage between the adjacent bucket covers may erode the covers where adjacent covers adjoin and increase leakage flow, adversely affecting the turbine operational efficiency.

BRIEF SUMMARY OF THE INVENTION

In one aspect, a method of fabricating a rotor assembly for a turbine is provided. The method facilitates minimizing radial leakage of a working fluid, the rotor assembly is rotatable about a longitudinal axis, and includes a radially outer rim and a plurality of buckets that extend radially outward from the radially outer rim, each of the buckets includes a blade including a pair of opposing sidewalls. The method includes forming a cover on each bucket radial tip wherein the cover includes a leading edge side in a direction of rotation, and a trailing edge side in the direction of rotation wherein the leading edge and trailing edges are parallel with respect to each other, and wherein the leading edge and trailing edges are skewed with respect to the axis of rotation. The method includes forming an extension in the cover leading edge side, forming a groove in the cover trailing edge side, and attaching each bucket to the radially outer rim, such that the extension in the cover leading edge side of one cover is in mating engagement with the groove in the cover trailing edge side of an adjoining cover.

In another aspect, a rotor assembly for a turbine is provided. The rotor assembly is rotatable about a longitudinal axis of the rotor assembly, and includes a radially outer rim and a plurality of buckets that extend radially outward from the radially outer rim wherein each of the buckets includes a blade that includes a pair of opposing sidewalls. The rotor assembly includes a cover formed on each bucket radial tip wherein the cover includes a leading edge side in a direction of rotor assembly rotation, and a trailing edge in the direction of rotor assembly rotation wherein the leading edge and trailing edges are parallel with respect to each other, and wherein the leading edge and trailing edges are skewed with respect to the axis of rotation. The rotor assembly also includes an extension formed in the cover leading edge side, and a groove formed in the cover trailing edge side, and wherein each bucket is attached to the radially outer rim, such that the extension in the cover leading edge side of one cover is in mating engagement with the groove in the cover trailing edge side of an adjoining cover.

A steam turbine is provided that includes a rotor assembly rotatable about a longitudinal axis of the rotor assembly, that includes a radially outer rim and a plurality of buckets that extend radially outward from the radially outer rim wherein each of the buckets includes a blade that includes a pair of opposing sidewalls, a cover that is formed on each bucket radial tip, wherein the cover includes a leading edge side in a direction of rotor assembly rotation, and a trailing edge in the direction of rotor assembly rotation wherein the leading edge and the trailing edge are parallel with respect to each other, and wherein the leading edge and the trailing edge are skewed with respect to the axis of rotation, and the cover is formed integrally with the blade. The steam turbine also includes a semi-circular extension formed in the cover leading edge side, and a semi-circular groove formed in the cover trailing edge side, and wherein each bucket is attached to the radially outer rim, such that the extension in the cover leading edge side of one cover is in mating engagement with the groove in the cover trailing edge side of an adjoining cover such that adjoining sides of the covers are slidingly engaged and in substantially metal-to-metal contact.

DETAILED DESCRIPTION OF THE INVENTION

Figure 1:
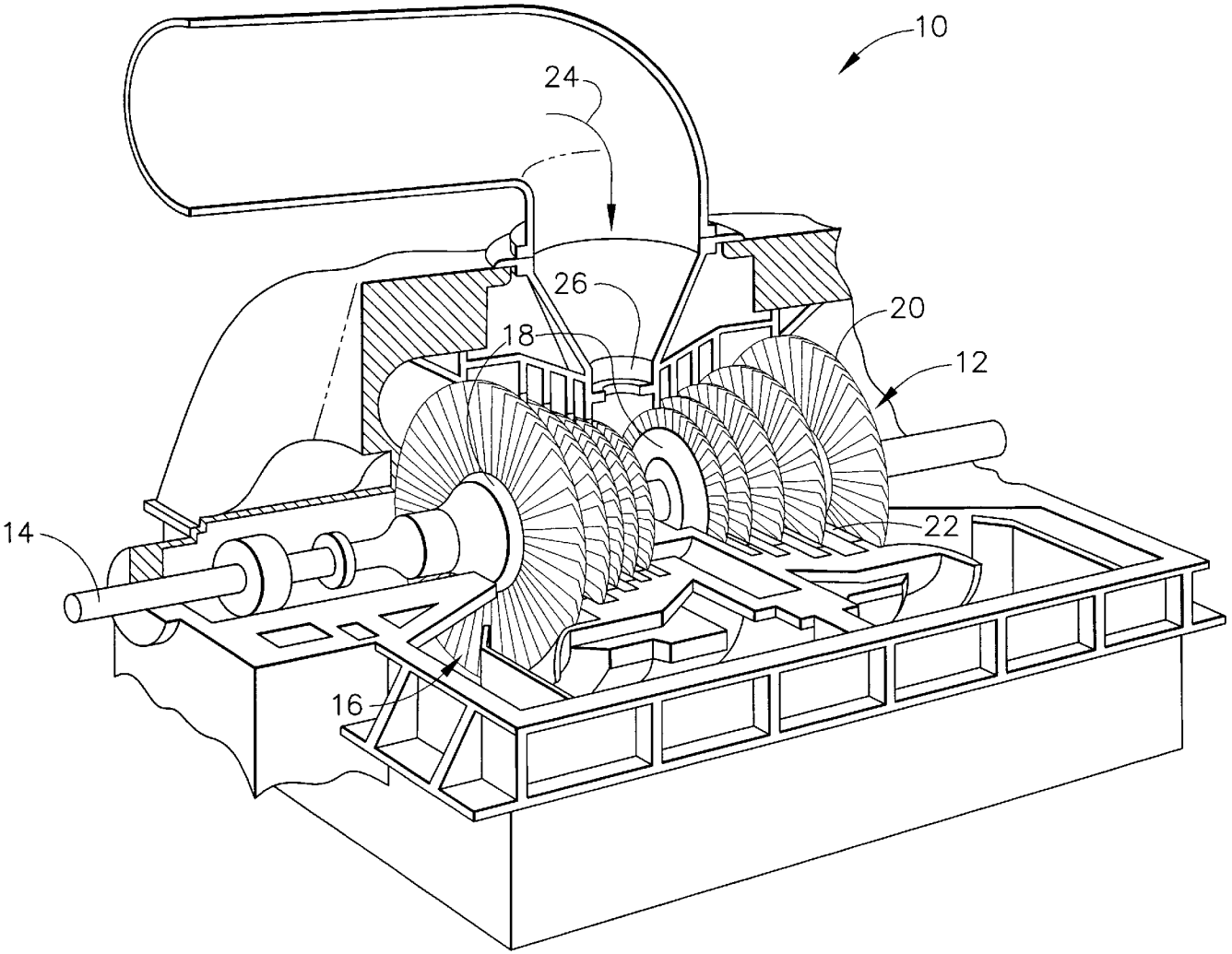
FIG. 1 is a perspective partial cut away view of a steam turbine.

FIG. 1 is a perspective partial cut away view of a steam turbine 10 including a rotor 12 that includes a shaft 14 and a low-pressure (LP) turbine 16. LP turbine 16 includes a plurality of axially spaced rotor wheels 18. A plurality of buckets 20 are mechanically coupled to each rotor wheel 18. More specifically, buckets 20 are arranged in rows that extend circumferentially around each rotor wheel 18. A plurality of stationary nozzles 22 extend circumferentially around shaft 14 and are axially positioned between adjacent rows of buckets 20. Nozzles 22 cooperate with buckets 20 to form a turbine stage and to define a portion of a steam flow path through turbine 10.

In operation, steam 24 enters an inlet 26 of turbine 10 and is channeled through nozzles 22. Nozzles 22 direct steam 24 downstream against buckets 20. Steam 24 passes through the remaining stages imparting a force on buckets 20 causing rotor 12 to rotate. At least one end of turbine 10 may extend axially away from rotor 12 and may be attached to a load or machinery (not shown), such as, but not limited to, a generator, and/or another turbine. Accordingly, a large steam turbine unit may actually include several turbines that are all co-axially coupled to the same shaft 14. Such a unit may, for example, include a high-pressure turbine coupled to an intermediate-pressure turbine, which is coupled to a low-pressure turbine. In one embodiment, steam turbine 10 is commercially available from General Electric Power Systems, Schenectady, N.Y.

Figure 2:
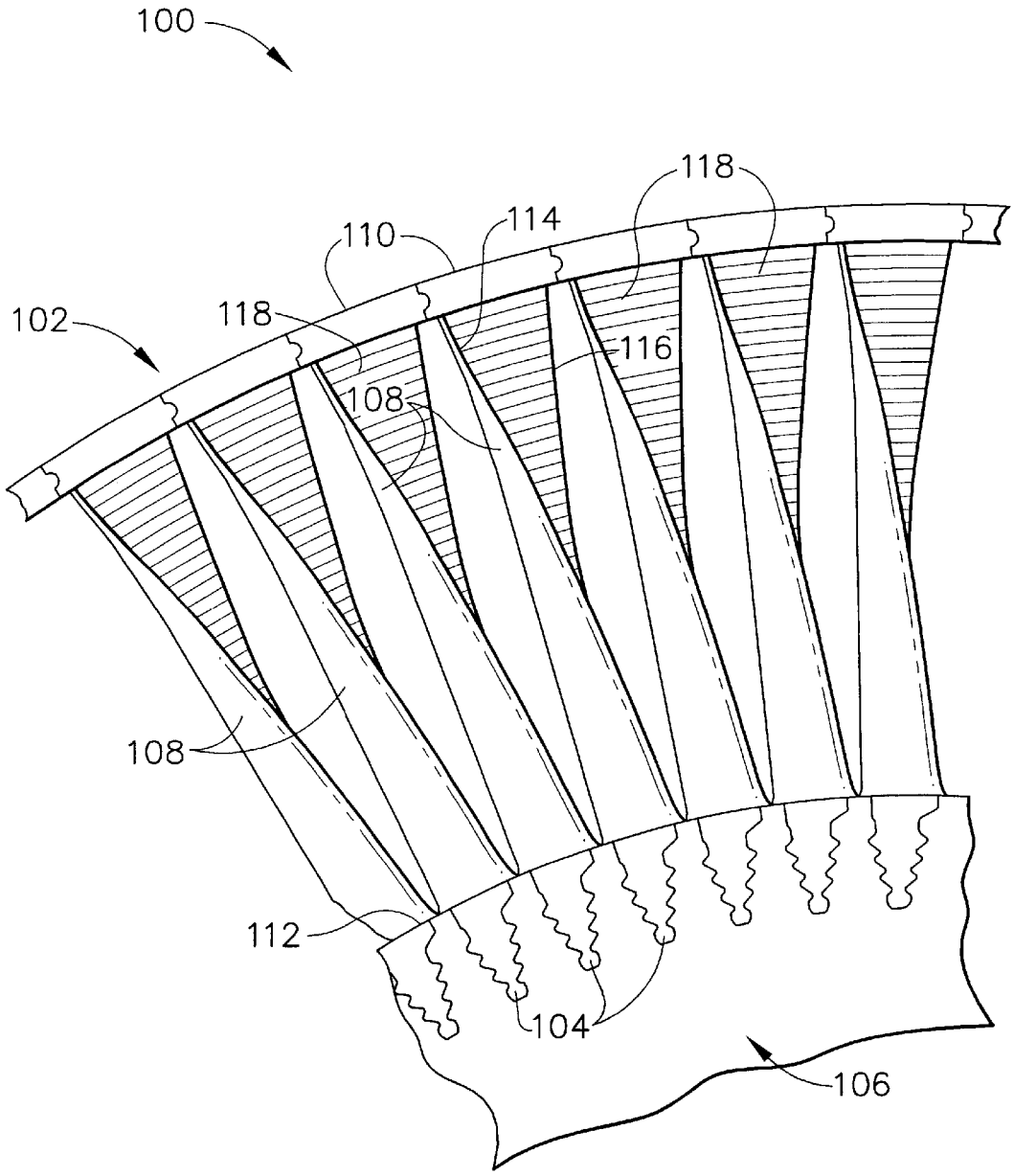
FIG. 2 is a partial cross-sectional view of a rotor assembly including a damper system and that may be used with the gas turbine engine shown in FIG. 1.

FIG. 2 is a partial cross-sectional view of a rotor assembly 100 that may be used with steam turbine 10. Rotor assembly 100 includes a plurality of buckets 102. Each bucket 102 includes a dovetail 104 attached to a complementary shaped extension of a shaft 106, a blade 108 extending radially outwardly from its respective dovetail 104, and a cover 110 formed on a radial extrema, or tip of each blade 108. In the exemplary embodiment, covers 110 are formed integrally with blades 108.

Blades 108 are configured for cooperating with a motive or working fluid, such as steam. In the exemplary embodiment illustrated in FIG. 2, rotor assembly 100 is a section of steam turbine 10, with blades 108 configured for suitably extracting energy from the motive fluid steam in succeeding stages. Outer surfaces or shoulders 112 of dovetails 104 define a radially inner flowpath surface of the turbine section as steam is directed from stage to stage.

Blades 108 rotate about the axial centerline axis up to a specific maximum design rotational speed, and generate centrifugal loads in rotating components. Centrifugal forces generated by rotating blades 108 are carried by dovetails 104 and portions of shaft 106 directly below each blade 108. Rotation of rotor assembly 100 and blades 108 from steam passing past blades 108 removes energy from the steam.

Blades 108 each include a leading edge 114, a trailing edge 116, and an airfoil 118 extending therebetween.

Figure 3:
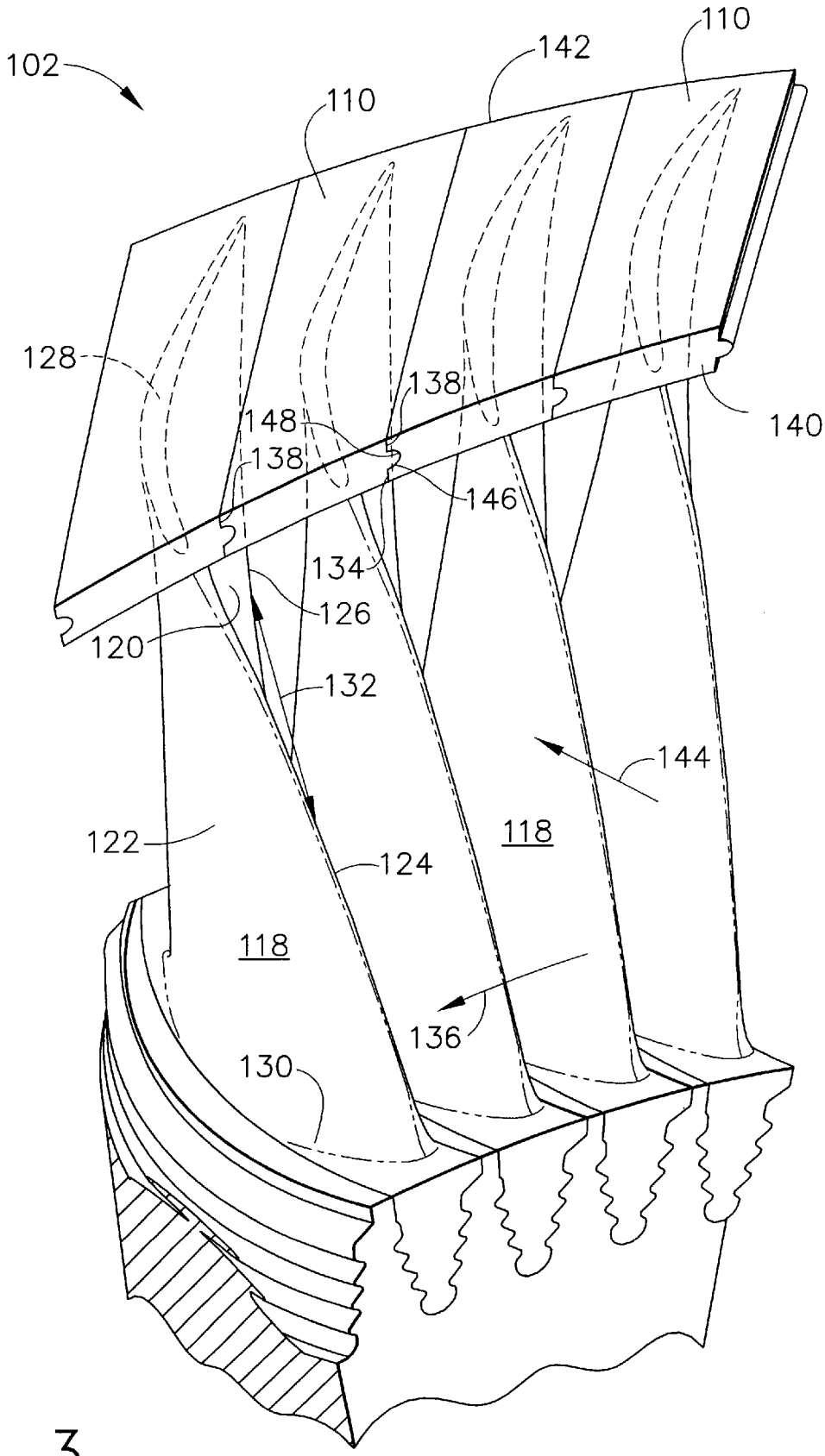
FIG. 3 is an enlarged perspective view of an exemplary portion of the rotor assembly including a plurality of adjacent buckets shown in FIG. 2.

FIG. 3 is an enlarged perspective view of a portion of rotor assembly 100 including a plurality of adjacent buckets 102. Airfoil 118 includes a high-pressure side 120 and a circumferentially opposite low-pressure side 122. High-pressure side 120 and low-pressure side 122, respectively, extend between axially spaced apart leading and trailing edges 124 and 126, respectively and extend in radial span between a rotor blade tip 128 and a rotor blade root 130. A blade chord 132 is measured between airfoil 118 leading and trailing edges 124 and 126, respectively.

Cover 110 includes a leading edge side 134 in a direction 136 of rotation, and a trailing edge side 138 in direction 136 of rotation. Cover 110 also includes an inlet edge side 140 and an outlet edge side 142 wherein inlet and outlet are referenced to a direction 144 of steam flow past airfoil 118. Leading edge side 134 is parallel with trailing edge side 138, and inlet edge side 140 and outlet edge side 142 are parallel. Leading edge side includes an extension 146 that extends circumferentially from leading edge side 134 toward trailing edge side 138 of adjacent cover 110. Trailing edge side 138 of cover 110 each includes a groove 148 that extends inwardly from trailing edge side 138 into cover 110. Groove 148 is sized and positioned to receive extension 146 in a sliding engagement.

Figure 4:
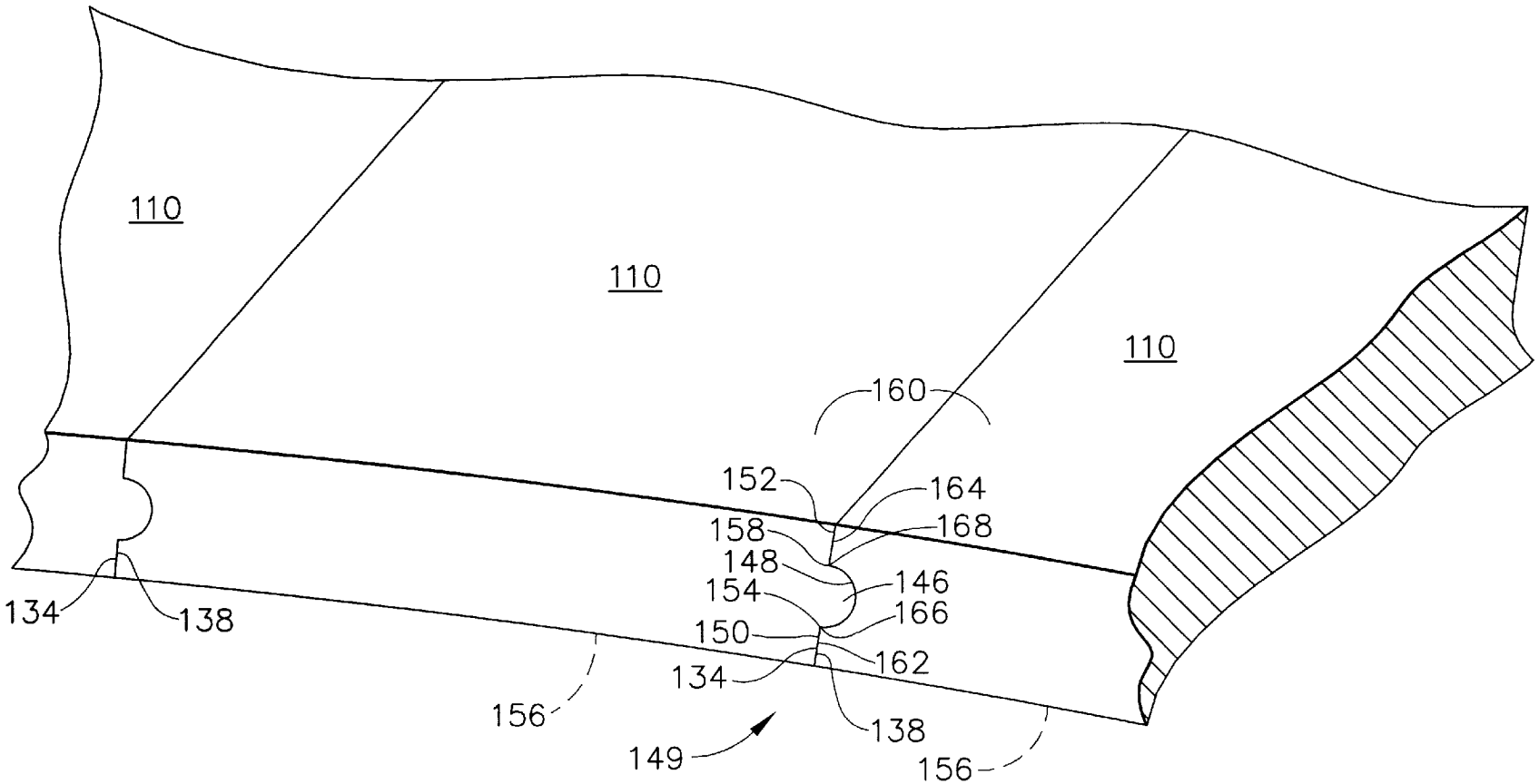
FIG. 4 is an enlarged elevation view of the cover that may be used with buckets shown in FIG. 3.

FIG. 4 is an enlarged elevation view of cover 110 that may be used with buckets 102 shown in FIG. 3. Leading edge side 134 and trailing edge side 138 of adjacent covers 110 meet to form a joint 149 when rotor assembly 100 is assembled. Leading edge side 134 includes extension 146, a inner radial portion 150 and an outer radial portion 152. Inner radial portion 150 extends radially inwardly from a first extent 154 of extension 146 to an undersurface 156 of cover 110. Outer radial portion 152 extends radially outwardly from a second extent 158 of extension 146 to an outersurface 160 of cover 110. Trailing edge side 138 includes groove 148, a inner radial portion 162 and an outer radial portion 164. Inner radial portion 162 extends radially inwardly from a first extent 166 of groove 148 to undersurface 156 of cover 110. Outer radial portion 164 extends radially outwardly from a second extent 168 of groove 148 to an outersurface 160 of cover 110.

In the exemplary embodiment, joint 149 includes metal-to-metal contact between corresponding surfaces of adjacent covers 110. Specifically, inner radial portion 150 of leading edge side 134 and inner radial portion 162 of trailing edge side 138 are butted together such that no intended gap exists between their respective surfaces. Likewise, outer radial portions 152 and 164 are similarly butted together such that substantially no gap exists between their respective mated surfaces. Additionally, extension 146 is received in groove 148 such that no intended gap exists between their respective surfaces. Further, leading edge side 134 and trailing edge side 138 are able to slide approximately axially, with respect to each other. Leading edge side 134 and trailing edge side 138 are restrained from sliding radially with respect to each other due to the engagement in the radial direction of extension 146 in groove 148.

In operation, during a startup of turbine 10, steam 24 is admitted into inlet 26. Steam 24 is directed past airfoil 118 between shoulder 112 and covers 110. Initially, steam 24 is hotter than airfoil 118, shoulder 112, and covers 110, and transfers heat to airfoil 118, shoulder 112, and covers 110. The heat causes expansion of airfoil 118, shoulder 112, and covers 110 which may be uneven and may tend to cause warpage of airfoil 118, shoulder 112, and covers 110. Additionally, steam 24 may tend to leak past joint 149 due to a pressure gradient that may exist across covers 110. To relieve compressive forces which may build up in airfoil 118 due to a thermal expansion of airfoil 118, covers 110 of adjacent buckets 102 may slide axially, allowing the compressive forces to dissipate. Because of the metal-to-metal engagement of sides 134 and 138 including extension 146 and groove 148, respectively, steam 24 is facilitated being blocked during expansion of the components within turbine 10.

Figure 5:
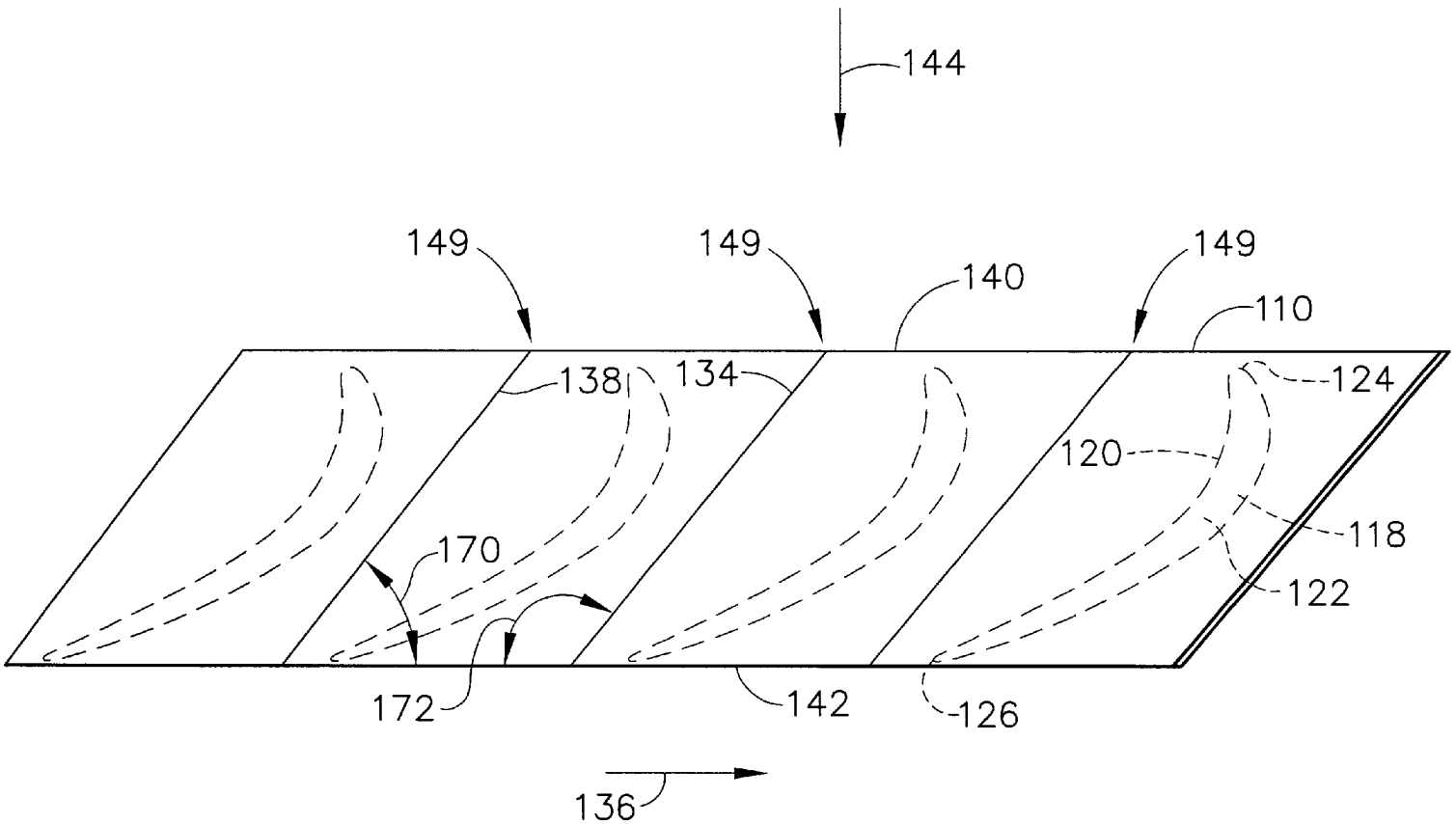
FIG. 5 is a plan view of an exemplary embodiment of the cover that may be used with the buckets shown in FIG. 3.

FIG. 5 is a plan view of an exemplary embodiment of cover 110 that may be used with bucket 102 as shown in FIG. 3. Each cover 110 includes leading edge side 134 that is parallel with trailing edge side 138, and inlet edge side 140 that is parallel with outlet edge side 142. An angle 170 is formed between sides 138 and 142. In the exemplary embodiment, angle 170 is an acute angle. Angle 170 being an acute angle facilitates sealing joint 149 during all operational modes of turbine 10. Sides 134 and 142 form an angle 172. In the exemplary embodiment, angle 172 is an obtuse angle. Because angles 170 and 172 are not right angles, sides 134 and 138 have a skew with reference to the longitudinal axis of rotor assembly 100. The skew in sides 134 and 138 facilitates maintaining a seal along joint 149. Additionally, in the exemplary embodiment, sides 134 and 138 are straight from side 140 to side 142. Some known bucket covers are S-shaped or Z-shaped when observed from a plan perspective. An S or Z shape to cover 110 would cause adjacent covers 100 to bind as they expanded due to thermal growth if they tried to slide in a first direction, or would cause a gap in joint 149 if they slid in the opposite direction.

The above-described rotor assembly is cost-effective and highly reliable. The rotor assembly includes an integral cover for each bucket that interlocks with each adjacent bucket to facilitate sealing radial leakage of working fluid. More specifically, seals include an extension and a groove formed in the cover that cooperate during various operational modes to maintain contact between the covers of adjacent covers. The covers are skewed with respect to a longitudinal axis and are slidably engaged to facilitate maintaining a seal between adjacent covers while facilitating stress relief between adjacent covers. During operation, the differential expansion of turbine bucket airfoils and covers may tend to open the cover seals. Additionally, a force generated by the differential expansion turbine bucket airfoils and covers may induce compressive stress in the turbine bucket airfoils and covers. The groove and extension seal, and skewed cover facilitate relieving the stress while maintaining the seal between adjacent covers. As a result, the bucket covers facilitate sealing a radial leakage area in the rotor assembly.

Exemplary embodiments of rotor assembly components are described above in detail. The components are not limited to the specific embodiments described herein, but rather, components of each assembly may be utilized independently and separately from other components described herein. Each rotor assembly component can also be used in combination with other rotor assembly components.

While the invention has been described in terms of various specific embodiments, those skilled in the art will recognize that the invention can be practiced with modification within the spirit and scope of the claims.

What is claimed is:

1. A method of fabricating a rotor assembly for a turbine to facilitate minimizing radial leakage of a working fluid, the rotor assembly, rotatable about a longitudinal axis, the rotor assembly including a radially outer rim and a plurality of buckets that extend radially outward from the radially outer rim, each of the buckets including a blade including a pair of opposing sidewalls, said method comprising the steps of:

forming a cover on each bucket radial tip, the cover including a leading edge side in a direction of rotation, and a trailing edge in the direction of rotation wherein the leading edge and the trailing edge are parallel with respect to each other, and wherein the leading edge and the trailing edge are skewed with respect to the axis of rotation;

forming an extension in the cover leading edge side;

forming a groove in the cover trailing edge side; and attaching each bucket to the radially outer rim, such that the extension in the cover leading edge side of one cover is in mating engagement with the groove in the cover trailing edge side of an adjoining cover.

2. A method in accordance with claim 1 wherein forming a cover on each bucket radial tip comprises forming the cover integrally with the blade.

3. A method in accordance with claim 1 wherein the cover includes an inlet flow side in the direction of fluid flow past the blade, and an outlet flow side in the direction of working fluid past the blade, such that the inlet flow side and the outlet flow side are parallel with respect to each other, and wherein forming a cover on each bucket radial tip comprises forming the cover such that an angle defined by the trailing edge side and the outlet edge side is acute.

4. A method in accordance with claim 1 wherein the cover includes an inlet flow side in the direction of fluid flow past the blade, and an outlet flow side in the direction of working fluid past the blade, such that the inlet flow side and the outlet flow side are parallel with respect to each other, and wherein forming a cover on each bucket radial tip comprises forming the cover such that an angle defined by the leading edge side and the outlet edge side is obtuse.

5. A method in accordance with claim 1 wherein forming an extension in the cover leading edge side further comprises forming a semi-circular extension in the cover leading edge side.

6. A method in accordance with claim 1 wherein forming an groove in the cover trailing edge side further comprises forming a semi-circular groove in the cover trailing edge side.

7. A method in accordance with claim 1 wherein attaching each bucket to the radially outer rim further comprises attaching each bucket to the radially outer rim such that each bucket cover extension is slidingly engaged with each adjoining bucket cover semi-circular groove.

8. A method in accordance with claim 1 wherein attaching each bucket to the radially outer rim further comprises attaching each bucket to the radially outer rim such that each bucket cover is in substantial metal-to-metal contact with each adjoining bucket at the leading edge side and the trailing edge side.

9. A method in accordance with claim 1 wherein each bucket is a reaction type bucket, and wherein forming a cover on each bucket radial tip comprises forming a cover on each reaction-type bucket radial tip.

10. A rotor assembly for a turbine, said rotor assembly rotatable about a longitudinal axis of said rotor assembly, said rotor assembly including a radially outer rim and a plurality of buckets that extend radially outward from said radially outer rim, each of said buckets includes a blade that includes a pair of opposing sidewalls, said rotor assembly comprising:

a cover formed on each bucket radial tip, said cover includes a leading edge side in a direction of rotor assembly rotation, and a trailing edge in said direction of rotor assembly rotation wherein said leading edge and trailing edges are parallel with respect to each other, and wherein said leading edge and trailing edges are skewed with respect to said axis of rotation;

an extension formed in said cover leading edge side; and a groove formed in said cover trailing edge side; and wherein each bucket is attached to said radially outer rim, such that said extension in said cover leading edge side of one cover is in mating engagement with said groove in said cover trailing edge side of an adjoining cover.

11. A rotor assembly for a turbine in accordance with claim 10 wherein said cover is formed integrally with said blade.

12. A rotor assembly for a turbine in accordance with claim 10 wherein said cover comprises an inlet flow side in said direction of fluid flow past said blade, and an outlet flow side in said direction of working fluid past said blade, such that said inlet flow side and said outlet flow side are parallel with respect to each other, said cover comprises an angle defined by said trailing edge side and said outlet edge side is acute.

13. A rotor assembly for a turbine in accordance with claim 10 wherein said cover comprises an inlet flow side in said direction of fluid flow past said blade, and an outlet flow side in said direction of working fluid past said blade, such that said inlet flow side and said outlet flow side are parallel with respect to each other, said cover comprises an angle defined by said leading edge side and said outlet edge side is obtuse.

14. A rotor assembly for a turbine in accordance with claim 10 wherein said extension in said cover leading edge side comprises a semi-circular extension in said cover leading edge side.

15. A rotor assembly for a turbine in accordance with claim 10 wherein said groove in said cover trailing edge side comprises a semi-circular groove in said cover trailing edge side.

16. A rotor assembly for a turbine in accordance with claim 10 wherein each bucket cover extension is slidingly engaged with each adjoining bucket cover semi-circular groove.

17. A rotor assembly for a turbine in accordance with claim 10 wherein each bucket cover is in substantial metal-to-metal contact with each adjoining bucket at said leading edge side and said trailing edge side.

18. A rotor assembly for a turbine in accordance with claim 10 wherein each bucket is a reaction type bucket.

19. A steam turbine comprising:

a rotor assembly rotatable about a longitudinal axis of said rotor assembly, said rotor assembly including a radially outer rim and a plurality of buckets that extend radially outward from said radially outer rim, each of said buckets includes a blade that includes a pair of opposing sidewalls;

a cover formed on each bucket radial tip, said cover includes a leading edge side in a direction of rotor assembly rotation, and a trailing edge in the direction of rotor assembly rotation wherein said leading edge and trailing edges are parallel with respect to each other, and wherein said leading edge and trailing edges are skewed with respect to said axis of rotation, said cover formed integrally with said blade;

a semi-circular extension formed in said cover leading edge side; and a semi-circular groove formed in said cover trailing edge side; and wherein each bucket is attached to said radially outer rim, such that said extension in said cover leading edge side of one cover is in mating engagement with said groove in said cover trailing edge side of an adjoining cover such that adjoining sides of said covers are slidingly engaged and in substantially metal-to-metal contact.

20. A steam turbine in accordance with claim 19 wherein said cover further comprises an inlet flow side in a direction of fluid flow past said blade, and an outlet flow side in a direction of working fluid past said blade, such that said inlet flow side and said outlet flow side are parallel with respect to each other, said cover comprises an angle defined by said trailing edge side and said outlet edge side that is acute.

* * * * *